United States Patent [19]

Kuroda et al.

[11] Patent Number: 4,991,419

[45] Date of Patent: Feb. 12, 1991

[54] METHOD OF MANUFACTURING SEAMLESS TUBE FORMED OF TITANIUM MATERIAL

[75] Inventors: Atsuhiko Kuroda; Yoshiaki Shida, both of Osaka; Hiroki Kawabata, Wakayama; Tetsuya Nakanishi, Wakayama; Kazuhiro Nakajima, Wakayama; Shigemitsu Kimura, Wakayama, all of Japan

[73] Assignee: Sumitomo Metal Industries, Ltd., Osaka, Japan

[21] Appl. No.: 437,273

[22] Filed: Nov. 16, 1989

[30] Foreign Application Priority Data

| | | | |
|---|---|---|---|
| Nov. 18, 1988 | [JP] | Japan | 63-293027 |
| Dec. 14, 1988 | [JP] | Japan | 63-317226 |
| Dec. 14, 1988 | [JP] | Japan | 63-317227 |
| Nov. 8, 1989 | [JP] | Japan | 1-290693 |

[51] Int. Cl.[5] ..... B21B 19/06

[52] U.S. Cl. ..... 72/97; 72/96

[58] Field of Search ..... 72/96, 97, 40, 45, 342, 72/365, 364, 700; 29/527.5, 527.6, 527.7; 148/11.5 R

[56] References Cited

U.S. PATENT DOCUMENTS

| | | | |
|---|---|---|---|
| 3,313,138 | 4/1967 | Spring et al. | 72/700 |
| 3,496,755 | 2/1970 | Guernsey | 72/700 |
| 3,581,384 | 6/1971 | Petersen et al. | 29/527.7 |
| 3,635,068 | 1/1972 | Watmough | 72/700 |
| 3,698,070 | 10/1972 | Sejournet | 29/527.6 |
| 4,409,810 | 10/1983 | Yamada | 72/97 |
| 4,578,974 | 4/1986 | Pozsgay et al. | 72/97 |

FOREIGN PATENT DOCUMENTS

| | | | |
|---|---|---|---|
| 202935 | 12/1982 | Japan | 72/700 |
| 2284053 | 12/1987 | Japan | 72/700 |
| 317203 | 12/1988 | Japan | 72/700 |
| 5606 | 1/1989 | Japan | 72/700 |

OTHER PUBLICATIONS

Bashanov et al., "Manufacture of Titanium Tubes on Helical Rolling Mills", Titanium and Titanium Alloys, Scientific and Technological Aspects, vol. 1, Proceedings of the Third International Conference on Titanium held in Moscow on May 18–21, 1976, pp. 313–320, published 1982.

Ostrenko et al., "Titanium and Titanium Alloy Pipe and Tube Production in the U.S.S.R.", Titanium and Titanium Alloys, Scientific and Technological Aspects, vol. 1, Proceedings of the Third International Conference on Titanium held in Moscow on May 18–21, 1976, pp. 321–326, published 1982.

*Primary Examiner*—Robert L. Spruill

*Attorney, Agent, or Firm*—Burns, Doane, Swecker & Mathis

[57] ABSTRACT

A method of manufacturing a seamless tube formed of a titanium material, such as pure titanium or titanium alloys, by the use of the Mannesmann's method. At first, an ingot formed of the titanium material is processed under the conditions that a heating temperature is 850° to 1,250° C., the final temperature being 600° to 1,100° C., and a working degree being 50% or more so as to be turned into a solid billet. The resulting solid billet is subjected to a piercing within a temperature range of $\beta$ transus −100° to 1,250° C. so as to be turned into a hollow piece. In this piercing process, inclined rolls of a piercer are descaled. The resulting hollow piece is, in case of need, regulated a size thereof by elongating so as to be turned into a hollow shell. Subsequently, the resulting hollow shell is subjected to a reducing step (reducing conditions: temperature at an inlet side of the mill is 600° to 1,100° C. and a reduction of the outside diameter is 80% or more) by means of a reducer mill or to a sizing step (sizing conditions: temperature at an inlet side of the mill is 550° to 1,150° C. and a reduction of the outside diameter is 3 to 15%) by means of a sizer mill.

25 Claims, 7 Drawing Sheets

METHOD OF MANUFACTURING SEAMLESS TUBE FORMED OF TITANIUM MATERIAL

BACKGROUND OF THE INVENTION

1. Field of the Invention

The present invention relates to a method of manufacturing a seamless tube formed of titanium materials including pure titanium and titanium alloys by the use of the Mannesmann's method.

2. Description of Related Art

The titanium materials are classified into pure titanium and the titanium alloys such as $\alpha$-type titanium alloys, and $\alpha+\beta$-type titanium alloys and $\beta$-type titanium alloys. The $\alpha$-type titanium alloys include Ti-0.15Pd, Ti-0.8Ni-0.3Mo, Ti-5Al-2.5Sn and the like. The $\alpha+\beta$-type titanium alloys include Ti-8Al-1Mo-1V, Ti-3Al-2.5V, Ti-6Al-4V, Ti-6Al-6V-2Sn, Ti-6Al-2Sn-4Zr-6Mo, Ti-6Al-2Sn-4Zr-2Mo and the like such as small amount of platinum group elements added alloys and platinum group elements plus small amount of Ni, Co, W, Mo added alloys. The $\beta$-type titanium alloys include Ti-3Al-8V-6Cr-4Mo-4Zr and the like. In the present invention, the titanium materials used as subject materials include the above-mentioned types of titanium alloys. Pure titanium is a titanium material which mainly has impurities such as H, O, N, Fe, its characteristic is changed according to quantity of O and Fe in particular.

These titanium materials are light and highly corrosion-resistant and in particular a seamless tube formed of them has been expected to be used for piping for use in chemical plants, an oil pressure piping for use in aircraft, and an oil field piping.

The seamless tube has been manufactured by the extrusion method or Mannesmann's method. The extrusion method is suitable for manufacturing a tube of materials inferior in workability, but inferior in manufacturing efficiency. On the contrary, Mannesmann's method is superior in manufacturing efficiency, but requires materials superior in workability.

Some trials for manufacturing a tube formed of a titanium material by Mannesmann's method have been performed, but a manufacturing technique for obtaining a good tube in quality has not been established yet (Reference: "Titanium And Titanium Alloys" volume 1, 1982, P. 313). Because of such circumstances, the seamless tube formed of titanium materials, as provided by JIS H-4630 and the like, has been manufactured by the use of the extrusion method with a little sacrifice of manufacturing efficiency and yield.

In order to manufacture the seamless tube efficiently and economically in general, it is preferable to adopt a continuous seamless tube-manufacturing line including an inclined roll piercing rolling-mill represented by a Mannesmann's piercer. In this case, the seamless tube is manufactured in the following order.

At first, a heated solid billet is subjected to the piercing in the inclined roll piercing rolling-mill or the press-roll type piercer to obtain a hollow piece. The obtained hollow piece is successively subjected to elongating in a mandrel mill or a plug mill to obtain a hollow shell. In the case where the mandrel mill is used in the elongating, the hollow shell is reheated in case of need and then subjected to reducing in a reducer mill while in the case where the elongating is executed in the plug mill, the hollow shell is reheated in case of need and then subjected to sizing in a sizer mill. The hollow piece after piercing is in case of need subjected to second piercing or hollow piece sizing and then subjected to the elongating.

In such a case where the seamless tube formed of the titanium materials is manufactured by the Mannesmann's method, besides the inferiority in workability, the following various kinds of problems have occurred.

If the deformability of the solid billet is insufficient when it is subjected to the piercing, surface defects, such as skin eruptions, flaws and cracks, are produced on an inner surface of the pierced material. In addition, even though a solid billet having a superior deformability is used, if the piercing conditions are not suitable, similar surface defects are produced. Since the titanium materials are inferior in deformability, such surface defects are frequently produced with ease.

Since titanium oxides formed on the surface of the titanium materials prior to the rolling are remarkably difficult to be separated, these titanium oxides are not broken but deposited in a concave portion of the rolls when the titanium materials are subjected to the piercing or the second piercing. Since such titanium oxides stuck to the roll surface are highly lubricious, a problem occurs in that the titanium materials slip and become inferior in intermeshing to the roll during the rolling process.

Furthermore, since the reducing or the sizing is the final process, the result of this reducing or sizing determines the surface quality of a product. Since titanium is originally inferior in hot workability (deformability), if it is intended to secure the dimensional accuracy required in this reducing or sizing, there is a possibility that the surface quality of the product is deteriorated. In particular, in using the reducer mill, it is necessary to contrive a design of roll grooves.

Because of such a state of matters, an art of manufacturing a seamless tube formed of titanium materials by the use of the Mannesmann's method has not been established yet.

SUMMARY OF THE INVENTION

The present invention has been achieved in view of the foregoing state of matters and proposes suitable conditions in each process of the Mannesmann's method properly including a piercing, a second piercing, a hollow piece sizing, an elongating, a sizing and a reducing so that a seamless tube formed of titanium materials may be manufactured with high accuracy by the use of the Mannesmann's method.

According to the method of the present invention, when an ingot is worked to produce a solid billet, the ingot is heated to a temperature of 850° to 1,250° C. and the final temperature is set at 600° to 1,100° C. and the working degree at 50% or more. In addition, the piercing of the solid billet is executed within a temperature range of $\beta$ transus $-100°$ to 1,250° C. Furthermore, in this piercing of the solid billet, a high-pressure water of 50 kg/cm$^2$ or more is blasted onto the inclined rolls used and the descaling of the inclined rolls is executed by means of a brush. Also, when the hollow piece is subjected to the second piercing, the descaling is similarly executed. In addition, in the case where the reducer mill is used in the reducing, a temperature of the hollow shell at an inlet side of the mill is set at 600° to 1,100° C., a reduction of outside diameter being set at 80% or less, and a rectangular ratio ($\lambda$) of roll grooves of the reducer mill being set as follows depending upon a wall-thickness (t) and an outside diameter (D) of the product. In the case where t/D is less than 10%, $\lambda \leqq 0.7$, in the case where t/D is 10% or more but less than 15%, $\lambda \leqq 0.8$, and in the case where t/D is 15% or more, $\lambda \leqq 0.9$. In the sizing process, in the case where a sizer mill is used, a temperature of the hollow shell at an inlet side of the mill is set at 550° to 1,150° C. and the reduction in outside diameter is set at 3 to 15%.

It is one object of the present invention to provide a method of manufacturing a seamless tube formed of titanium materials capable of manufacturing a seamless tube formed of titanium materials exhibiting no surface defects, such as skin eruptions, flaws and cracks, being superior in mechanical characteristics, by the use of the Mannesmann's method.

It is another object of the present invention to provide a method of manufacturing a seamless tube formed of titanium materials capable of manufacturing a seamless tube formed of titanium materials with high efficiency and producing no miss-roll by the use of the Mannesmann's method.

The above and further objects and features of the invention will more fully be apparent from the following detailed description with accompanying drawings.

DESCRIPTION OF THE PREFERRED EMBODIMENTS

Figure 1:
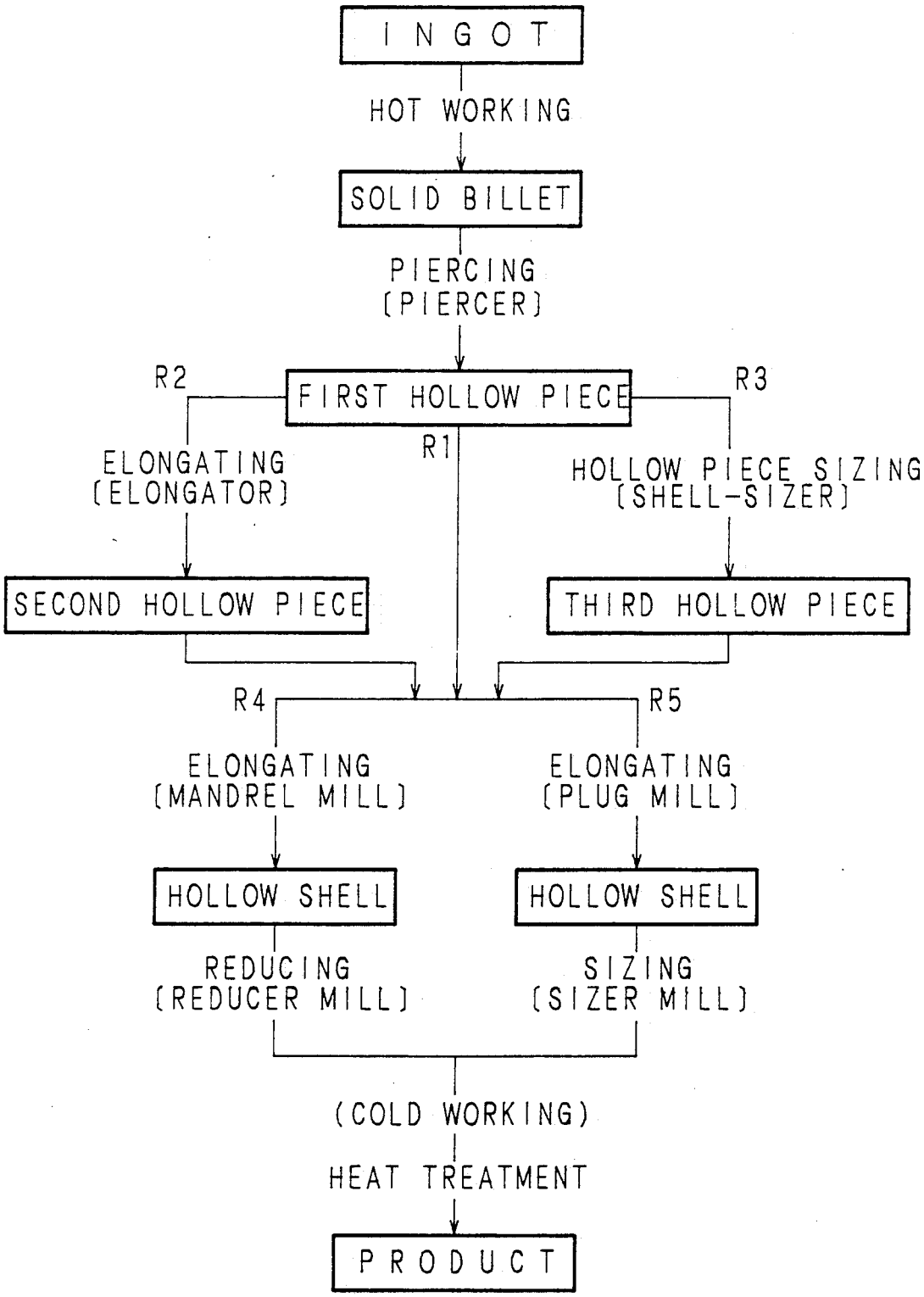
FIG. 1 is a chart showing processes of a method of manufacturing a seamless tube formed of titanium materials according to the present invention.

FIG. 1 is a chart showing main processes of a method of manufacturing a seamless tube formed of titanium material by the use of the Mannesmann's method according to the present invention. At first, an ingot formed of pure titanium or titanium alloys is heated to produce a heated solid billet. In this step, a heating temperature is set at 850° to 1,250° C., the final temperature being set at 600° to 1,100° C., and a working degree being set at 50% or more. Here, the working degree is (cross sectional area of the ingot − cross sectional area after the process) ÷ cross sectional area of the ingot × 100 (%).

Then, this solid billet is subjected to piercing by means of a piercer to produce a first hollow piece. In this time, a temperature range is set $\beta$ transus − 100° to 1,250° C. In addition, here $\beta$ transus is a temperature of a transformation from $\beta$ single phase to $\alpha+\beta$ dual phases.

Here, three courses can be thought as a course reaching the subsequent elongating process. A first course is a course (R1 in FIG. 1) directly reaching the elongating process. A second course is a course (R2 in FIG. 1) in which the first hollow piece is subjected to a second piercing (elongating) process by means of an elongator to be turned into a second hollow piece and then this second hollow piece arrives at the elongating process. A third course is a course (R3 in FIG. 1) in which this first hollow piece is subjected to a hollow piece sizing process by means of a shell-sizer to be turned into a third hollow piece and then this third hollow piece arrives at the elongating process. The process, in which the solid billet is subjected to the piercing to be turned into the first hollow piece, and the process, in which the first hollow piece is subjected to the second piercing to be turned into the second hollow piece, are executed with blasting a high-pressure water of 50 kg/cm$^2$ or more onto the inclined rolls of the rolling mill and descaling the inclined rolls by means of a brush.

The following process is divided into two courses. The first course is a course (R4 in FIG. 1) in which the hollow piece is subjected to the elongating by means of a mandrel mill to produce a hollow shell and then this hollow shell is subjected to the reducing by means of the reducer mill. The second course is a course (R5 in FIG. 1) in which the hollow piece is subjected to the elongating by means of a plug mill to be turned into a hollow shell and then the hollow shell is subjected to the sizing by means of a sizer mill. Here, in the case of the reducing by means of the reducer mill, a temperature at an inlet side of the mill is set at 600° to 1,100° C. and the reduction of outside diameter at 80% or less. In the case of the sizing by means of the sizer mill, the temperature at an inlet side of the mill is set at 550° to 1,150° and the reduction of outside diameter at 3 to 15%. After a series of these hot working processes, the hollow shell is in case of need subjected to cold working and then subjected to the heat treatment, and finally the product (a seamless tube formed of titanium materials) is manufactured.

The details of the respective processes will be below described with reasons why the conditions in the respective processes are limited as center.

An ingot as it has been cast shows a coarse cast structure which is remarkably inferior in deformability. In addition, it also contains voids. Accordingly, if such an ingot is heated and subjected to piercing by means of the piercer as it is, surface defects, such as flaws and cracks, are produced on an inner surface of the hollow piece due to the insufficient deformability when pierced.

So, according to the method of the present invention, at first the ingot is subjected to a suitable working to be turned into a billet having a structure suitable for the piercing process. The ingot is heated to temperatures of 850° to 1,250° C. but the absorption of hydrogen gases and/or stable oxidized layer are produced at high temperatures exceeding 1,250° C. Forging cracks are generated at the beginning of the process due to the worsened deformability of the ingot at temperatures lower than 850° C.

The final temperature is set at 1,100° C. or less but 600° C. or more. The final temperature has important influence upon the minute structure of the billet after the process. If the final temperature is higher than 1,100° C., the structure after the process is not minute and the obtained billet does not have a superior deformability. If the lower of the final limit temperature after the process is too low, cracks are produced in the forging process due to the worsened deformability, so that it is necessary that the lower limit of the final temperature is set at 600° C. or more. In addition, here the temperature may be selected with a surface temperature of the ingot or billet as standard in the actual operation.

It is another important matter in this process that the working degree is set at 50% or more. The inhomogenous structure and voids within the ingot can be cancelled and the obtained billet can be superior in deformability by setting the working degree at 50% or more within the above described temperature range.

The billet, which has been produced in the preceding process, is subjected to the piercing within a temperature range from 1,250° C. to $\beta$ transus $-100°$ C. In this case, the billet, which has been obtained in the preceding process, may be supplementarily heated in case of need and successively subjected to the piercing or the billet, which has been once cooled to normal temperature, may be heated again and then subjected to the piercing. If the piercing is executed at temperatures exceeding 1,250° C., a fragile phase called $\alpha$-case due to the absorption of oxygen and nitrogen is formed on the surface of the billet and this $\alpha$-case induces cracks in the piercing process to generate surface defects, such as cracks, on the outer surface of the hollow piece.

The deformability of the billet is reduced with a reduction of the piercing temperature. If the piercing is executed at temperatures lower than $\beta$ transus $-100°$ C., the deformability becomes insufficient, whereby surface defects, such as skin eruptions, flaws and cracks, are produced on the inner surface of the hollow piece after the piercing. In addition, the piercing temperature is a surface temperature of the solid billet before the piercing.

Ti-6Al-4V ($\beta$ transus $\approx 990°$ C.) was used as a representative $\alpha+\beta$-type titanium alloy. Its chemical composition is shown by (a) in Table 1.

A material having a size shown in Table 2 was cut out from an ingot casting having an outside diameter of 750 mm and a length of 3,000 mm and subjected to a hot forging under the conditions also shown in Table 2. The finishing outside diameter size was set at $\phi$ 70 mm in case of the material for an inclined roll type piercer, which will be mentioned later, and □ 65 mm in case of the material for a press roll type piercer. The finishing temperature of the forging was controlled by the surface temperature.

The piercing tests were carried out by the use of a two-roll Mannesmann's piercer (of inclined roll type) with barrel type rolls and a press roll type piercer.

In the case where the inclined roll type piercer was used, a cylindrical billet having an outside diameter of 60 mm and a length of 250 mm was taken out from a forging material having an outside diameter of 70 mm by machining and heated at a heating temperature shown in Table 2 for 2 hours followed by piercing at a piercing ratio (a ratio of a length after the piercing to that before the piercing) of 2.1. In this time, an angle of inclination of rolls was set at 12°. The piercing was executed for 3 pieces under the respective conditions. The surface temperature of the billet immediately before the piercing in this time is shown in Table 2 by a mean value for 3 pieces of material to be pierced.

In the case where the press roll type piercer was used, a billet having a rectangular cross section with a side length of 60 mm and a length of 250 mm was taken out from a forging material having a rectangular cross section with a side length of 65 mm by machining and heated at a temperature shown in Table 2 for 2 hours followed by piercing at a piercing ratio of 1.3. The piercing was executed for three pieces under the respective conditions. The surface temperature of the billet immediately before the piercing in this time is shown in Table 2 by a mean value for 3 pieces of material to be pierced.

The evaluation after the piercing was conducted for all 3 pieces of material to be tested on the piercing obtained under the respective conditions of the piercing test.

The material for the piercing test was longitudinally divided into 8 equal parts in a circumferential direction all over the length thereof and then descaled all over the length of an inner surface and an outer surface thereof by sand-blasting followed by investigating the existence of flaws by the penetration test. The investigation was executed for 48 surfaces (3 pieces of material to be tested on the piercing $\times$ number of divided parts of $8\times 2$ surfaces of the inner surface and the outer surface) under the respective conditions of the piercing test. The penetration test was conducted in compliance with JIS Z-2343 by the use of a washable dyeing penetrant. In the case where a defect having a length of 1 mm or more was detected at at least one place on the inner surface and the outer surface (48 surfaces) by this penetration test, the result of the penetration test was indicated by $\times$ in Table 2. In addition, in the case where no defect was detected on the inner surface and the outer surface (48 surfaces), the result of the penetration test was indicated by .

It is found from the results shown in Table 2 that in both the case where the inclined roll type piercer is used and the case where the press roll type piercer is used, a pierced material having no surface defects, such as skin eruptions, flaws and cracks, on both the inner surface and the outer surface can be obtained merely in the case where a temperature of an ingot at the completion of the forging is 1,100° C. or less but 600° C. or more, the working degree from the ingot to the billet being 50% or more, and the piercing being executed within the temperature range from 1,250° C. or less to $\beta$ transus $-100°$ C. or more.

A Ti-6Al-2Sn-4Zr-6Mo alloy ($\beta$ transus $\approx 960°$ C.) shown by (b) in Table 1 was used as another material. In this example, rolling was used as the working method for turning the ingot into the billet. The rolling conditions are shown in Table 3. In addition, the piercing test was conducted by means of merely the inclined roll type piercer in view of the fact that no difference was found between the case where the press roll type piercer was used and the case where the inclined roll type piercer was used in the previous example (Table 2). The finishing size, the piercing test method and the evaluation method after the piercing are the same as in the previous example. The results are shown in Table 3.

It is found from the results shown in Table 3 that in the case where the ingot is worked (production of the billet) and subjected to the piercing within the conditions according to the present invention, a hollow piece having no surface defects, such as skin eruptions, flaws and cracks, on both the inner surface and the outer surface thereof can be obtained in the same manner as in the previous example.

Figure 2:
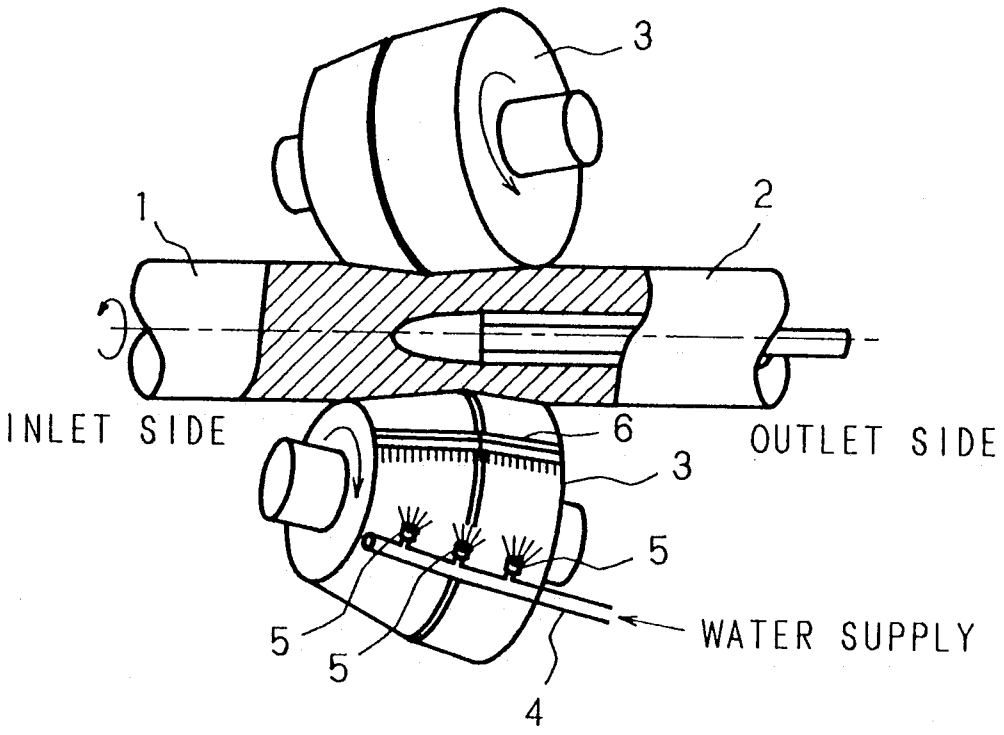
FIG. 2 is a schematic diagram showing a piercing process of a solid billet by means of an inclined roll type piercer.

According to the present invention, when a solid billet is subjected to the piercing by means of an inclined roll type piercer, the surface of the inclined rolls of the piercer is descaled by blasting the high-pressure water thereonto. FIG. 2 is a schematic diagram showing the piercing process of the solid billet by means of the inclined roll type piercer. Referring to FIG. 2, a left side is an inlet side and the solid billet 1 is subjected to the piercing by means of the piercer to produce a first hollow piece 2. The piercer is provided with piping 4 for supplying the high-pressure water in the vicinity of two pieces of barrel type rolls 3 thereof. The piping 4 is provided with a plurality of nozzles 5 and the high-pressure water is blasted onto the surface of the rolls 3 through the nozzles 5. In addition, the rolls 3 are provided with a brush 6 for descaling the surface thereof. And, when the solid billet 1 is subjected to the piercing, the high-pressure water is blasted through the nozzles 5 to remove titanium oxides stuck to the surface of the rolls 3 by means of said brush 6.

The respective solid billets were subjected to the piercing with descaling under the descaling conditions shown in Table 4 to produce the first hollow piece. A piercing efficiency and the miss-roll rate in this example are shown in Table 4. In addition, a substance A in Table 4 is formed of pure titanium (JIS H-4630) and a substance B is formed of a titanium alloy (Ti-6Al-4V).

It is found from the results shown in Table 4 that the slip of the solid billet due to titanium oxides left on the surface of the inclined rolls can be prevented by providing the brush on the inclined rolls and descaling the inclined rolls by blasting the high-pressure water having a water pressure of 50 kg/cm$^2$ or more to enhance the stability of the piercing, by means of the inclined roll type piercer.

In addition, such a descaling treatment is effective for an increase of the stability of the operation also in the second piercing process form the first hollow piece to the second hollow piece.

Next, the reducing process using the reducer mill will be described.

Characteristics of titanium are greatly dependent upon temperature and in particular when it is subjected to the reducing under the condition that the temperature at the inlet side of the reducer mill is lower than 600° C., its deformability is worsened, so that flaws, such as skin eruption-like, striped, edge marks and holes due to the jamming of the rolls, are produced. In addition, titanium alloys produce voids on the boundary surface between the $\alpha$-phase and the $\beta$-phase when they are subjected to the deformation due to a difference between the $\alpha$-phase and the $\beta$-phase in deformability. On the contrary, when they are subjected to the reducing under the condition that the temperature at the inlet side of the reducer mill exceeds 1,100° C., coarse acicular structures are produced due to the cooling after the reducing. These acicular structures have a poor room-temperature ductility and deteriorate mechanical properties of the product. Accordingly, the temperature of the hollow shell at the inlet side of the reducer is set at 600° to 1,100° C.

If the reduction of the outside diameter in the reducing exceeds 80%, outer-surface flaws, such as stripe-like and edge marks due to the jamming of the rolls, are produced and the surface properties of the product are deteriorated even though the temperature of the hollow shell at the inlet side of the reducer mill is suitably controlled. Accordingly, the reduction of the outside diameter in the reducing is set at 80% or less. In addition, the reducer mill can be used as a shape-regulating and correcting means at small reductions of the outside diameter according to circumstances. In this case, no evil influence occurs, so that the lower limit of the reduction of outside diameter is not specially limited.

A solid billet having an outside diameter of 187 mm and a length of 2,250 mm formed of industrial pure titanium having the composition shown in Table 5 (JIS H-4630-3) was subjected to the piercing by means of an inclined roll type piercer at the temperature at the inlet side of the piercer of 1,050° C. to be turned into a first hollow piece having an outside diameter of 192 mm, a wall-thickness of 20.62 mm and a length of 5,470 mm and the resulting first hollow piece was subjected to the hollow piece sizing by means of a shell sizer at the temperature at the inlet side of the shell-sizer of 1,000° C. to obtain a third hollow piece having an outside diameter of 168 mm, a wall-thickness of 22.0 mm and a length of 6,020 mm.

Successively, the obtained third hollow piece was subjected to the elongating by means of a 7-stand mandrel mill at the temperature at the inlet side of the mandrel mill of 900° C. to obtain a hollow shell having an outside diameter of 140 mm, a wall-thickness of 6.0 mm and a length of 24,040 mm. In this step, an elongation ratio was set at 4.

Subsequently, the obtained hollow shell was reheated and subjected to the reducing by means of a 3-roll 24-stand reducer mill at the temperature at the inlet side of the reducer mill of 850° C. (constant) with varying the reduction of outside diameter. Properties of the seamless tube formed of pure titanium after the reducing and those of the seamless tube formed of pure titanium after annealing for 1 hour at 750° C. are shown in Table 6. In addition, properties and characteristics of the hollow shell before the reducing and the standard values for the hollow shell formed of industrial pure titanium (JIS H-4630-3) of the same grade produced by hot extrusion and cold drawing in combination are shown in Table 6 for reference.

In the case (No. 6) where the reduction of outside diameter exceeded 80%, a notable jamming of rolls and edge marks were produced while in the case where the reduction of outside diameter was 80% or less, good surface properties were obtained and also mechanical characteristics meet all of the standard values for the hollow shell produced by the hot extrusion and the cold drawing in combination.

The results obtained when the same hollow shell was subjected to the reducing until an outside diameter of 63.5 mm and a wall-thickness of 5.75 mm (reduction of outside diameter: 54.6%) at various temperatures are shown in Table 7. In the case where the temperature at the inlet side of the mill is 500° C. (No. 1), a rough skin is produced on an inner surface of the hollow shell but in the case where the temperature at the inlet side of the mill is 600° to 1,100° C. (No. 2 to 4), both the surface properties and the mechanical characteristics are good.

Subsequently, a Ti-6Al-4V alloy having a composition shown in Table 8 was subjected to the same test as above described. The results are shown in Tables 9, 10.

As is evident from Tables 9, 10, the reducing conditions according to the present invention in using the reducer mill are effective also for the hollow shell formed of titanium alloys.

The titanium material is anisotropic in deformation, so that its degree of polygon formation is increased in comparison with that of plain carbon steels and also its phase characteristics are different from those of plain carbon steels in the hollow reducing such as the reducing.

Figure 3:
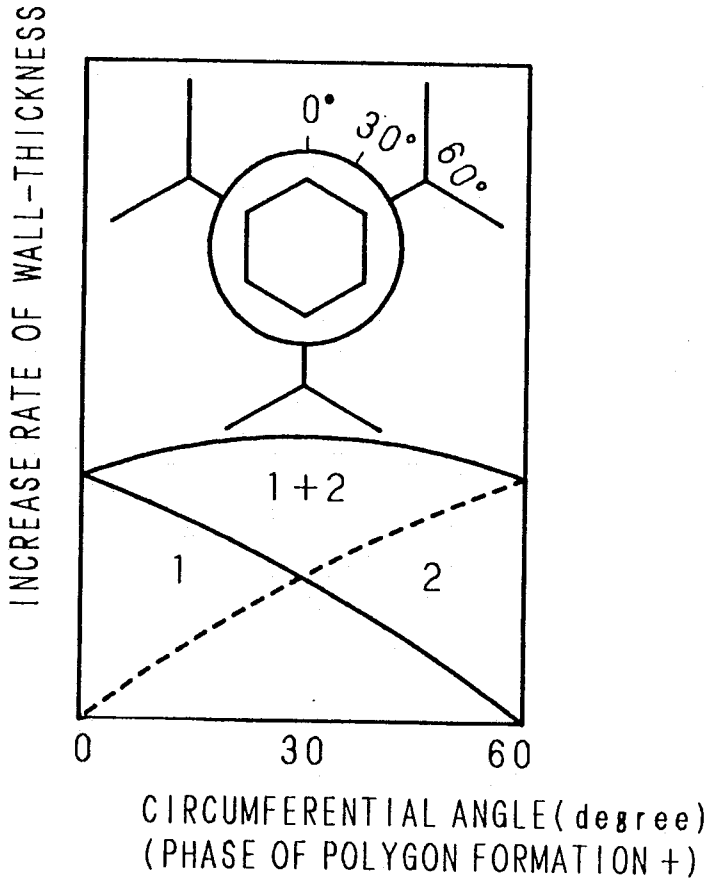
FIGS. 3 and 4 are diagrams showing a polygon phase.
Figure 4:
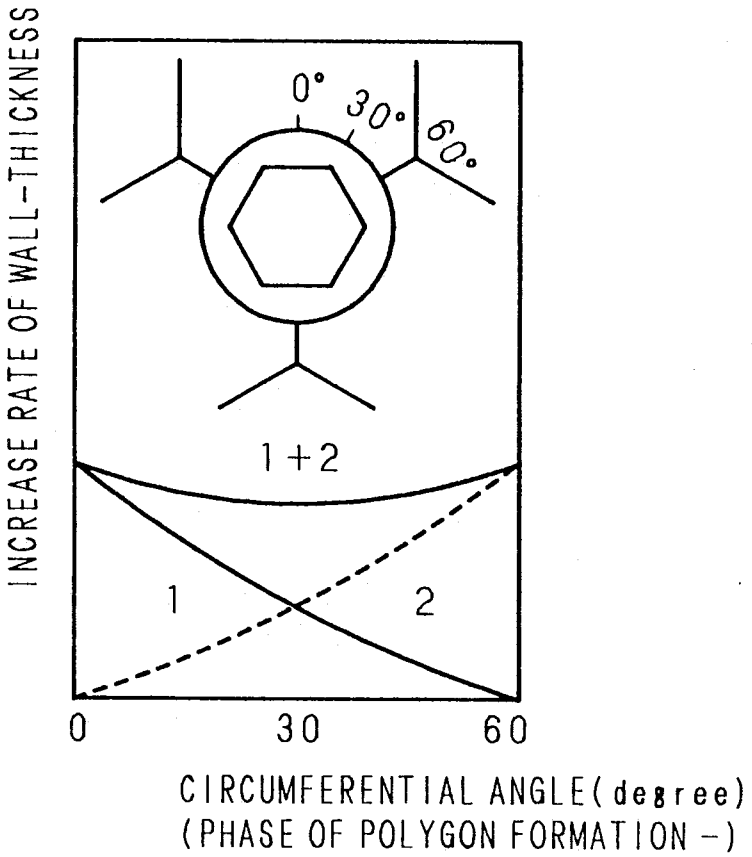

FIGS. 3, 4 are graphs showing a polygon formation phase produced in the case where the reducing is conducted in a 3-grooved roll stand. FIG. 3 shows a positive phase and FIG. 4 shows a negative phase. Although it is described in detail later, most of the plain carbon steels show the positive phase while titanium is apt to show the negative phase.

Figure 5:
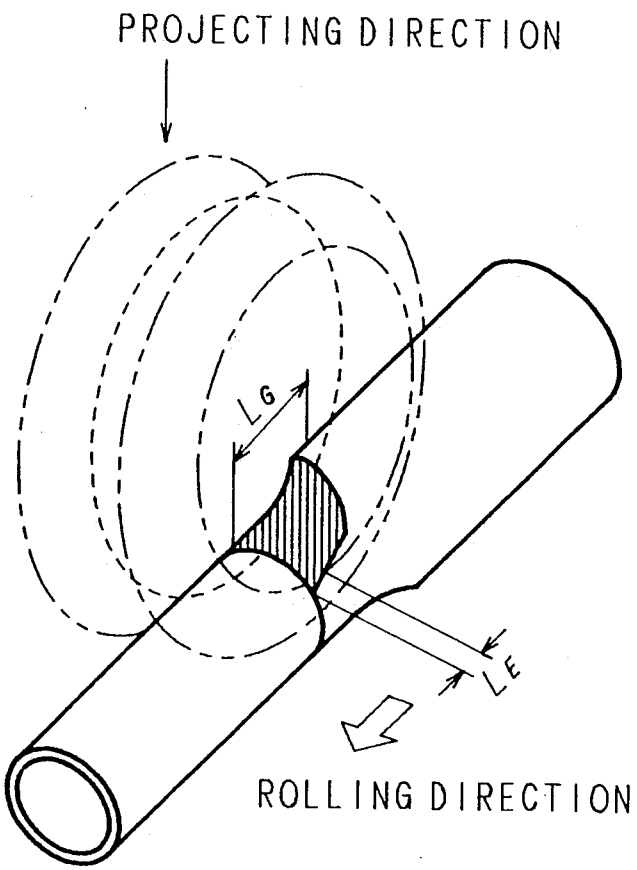
FIG. 5 is a perspective view showing a shape of a contact surface of rolls.

In order to suppress the polygon formation in the reducing, it has been known that the regulation of the projection shape of the roll-contact surface hatched in FIG. 5 when projected in a direction shown by an arrow is effective. In case of plain carbon steels, the roll groove is designed so that the projection shape of this roll-contact surface may be rectangular. That is to say, in the reducing of plain carbon steels, the rectangular ratio of rolls (contact-length $L_E$ of an edge portion / contact-length $L_G$ of a groove portion) is brought close to 1 and a uniform outside pressure deformation is added in a circumferential direction to make a quantity of deformation in wall-thickness uniform in the circumferential direction, whereby suppressing the polygon formation.

This design method presupposes the calculation of the contact-area on the basis of the shape of the roll grooves between the preceding stand and the present stand. Since the roll groove is not perfectly filled with the tube, the actual contact-area is smaller than that calculated by the use of the design rectangular rate. One of reasons for this is the reduction of the outside diameter by the tension of the tube between the stands.

The titanium material is anisotropic in deformation, so that it is difficult to be deformed in the circumferential direction and the reduction of outside diameter between the stand is smaller in comparison with that of steels. As a result, the actual rectangular ratio of the contact-surface of the hollow shell for the roll groove is larger in comparison with that of the plain carbon steels. Thus, the polygon phase showing the positive phase of the plain carbon steels is apt to be turned into the negative phase in the case of titanium. Accordingly, the conventional measure against the polygon formation phenomenon, in which the rectangular ratio of roll grooves is brought close to 1, brings about the opposite effect in the case of titanium.

Figure 6:
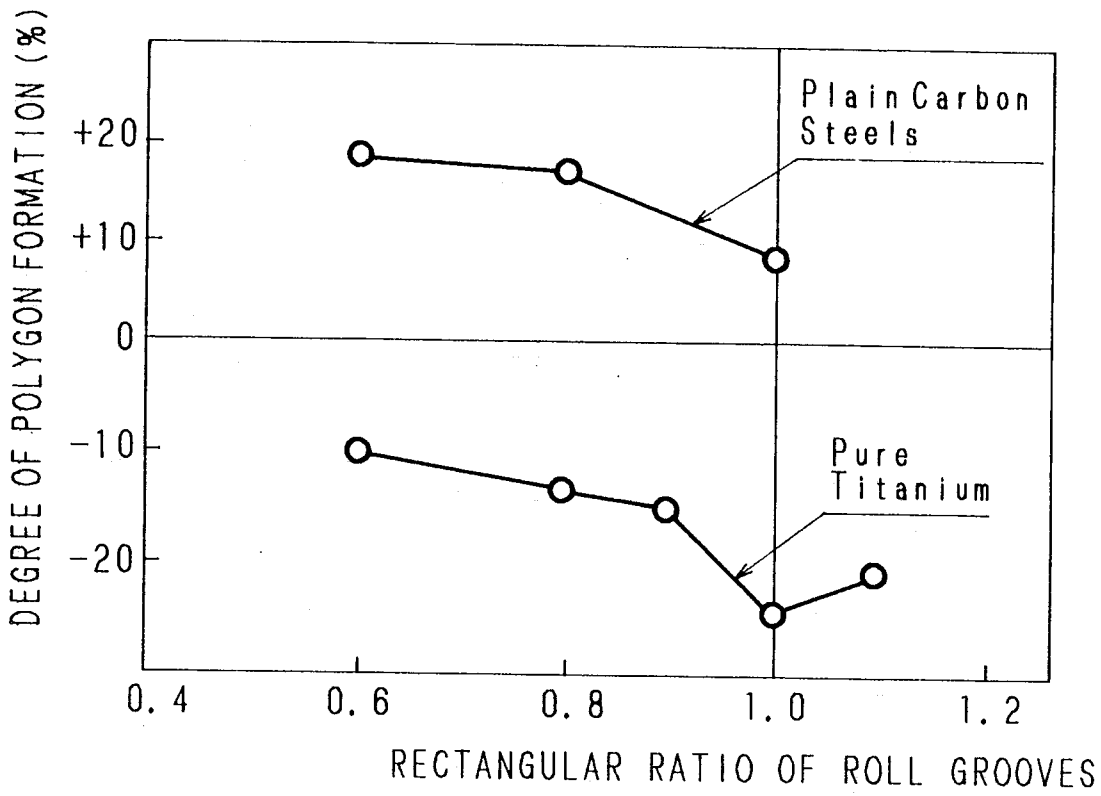
FIG. 6 is a graph showing a relation between a rectangular ratio of roll grooves and a degree of polygon formation for plain carbon steels and pure titanium.

FIG. 6 is a graph showing a relation between the rectangular ratio of roll grooves and the degree of polygon formation when the hollow shell formed of plain carbon steels (C%=0.2%) and pure titanium is subjected to the reducing at the reduction of outside diameter of 55% and t/D=17%. In the case of the plain carbon steels, the degree of polygon formation amounts to about +20% at the rectangular rate of roll grooves of 0.8 or more and it is reduced to less than 10% at the rectangular rate of roll grooves of 1.0. On the contrary, in the case of pure titanium, the negative polygon formation is brought about and its rate is increased with the approach of the rectangular ratio of roll grooves to 1.

Figure 7:
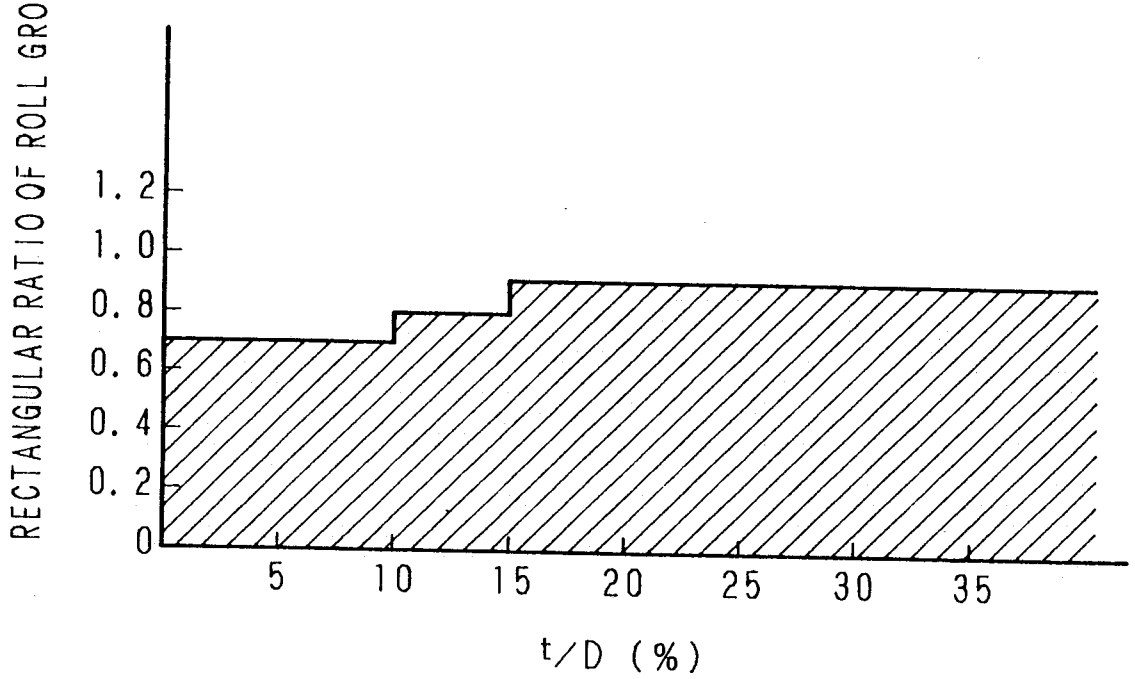
FIG. 7 is a graph showing a range of the rectangular ratio of roll grooves effective for a polygon formation.

According to the investigation by the present inventors, the rectangular ratio λ of roll grooves effective for suppressing the polygon formation in the case where titanium material is subjected to the reducing, as shown in FIG. 7, is varied depending upon the ratio t/D, which is a ratio of the wall-thickness t to the finishing outside diameter D by the reducer mill and the following relations have been determined.

When $t/D < 10\%$, $\lambda \leqq 0.7$;
when $10\% \leqq t/D < 15\%$, $\lambda \leqq 0.8$; and
when $15\% \leqq t/D$, $\lambda \leqq 0.9$.

In view of this point, in the above described preferred embodiment, the roll groove is designed so that the rectangular ratio of all reducing rolls excepting the intermeshing guide rolls and finishing rolls may be 0.8, whereby the degree of polygon formation is suppressed to 15% or less in the absolute value. In addition, in view of no problem in the properties of the inner and outer surfaces and the completion of the reducing, the lower limit of the rectangular ratio of roll grooves is set at 0 or more, preferably 0.2 or more when $t/D < 10\%$, 0.3 or more when $10\% \leqq t/D < 15\%$, and 0.4 or more when $15\% \leqq t/D$.

Although the polygon formation after the reducing does not deal the product a fatal defect, it goes without saying that the quality of the product can be still more improved by suppressing it. In addition, the degree of polygon formation is a value shown by the following equation.

$$\frac{\overline{t_{max}} - \overline{t_{min}}}{(D/2 - t_{min}) \times 0{,}135} \times 100\ (\%)$$

D: Nominal diameter;
$ti_{max}$: Maximum wall-thickness in one side of a hexagon;
$ti_{min}$: Minimum wall-thickness in one side of a hexagon;

$$t_{max} = \frac{\sum^{6} \overline{ti_{max}}}{6}$$

$$t_{min} = \frac{\sum^{6} \overline{ti_{min}}}{6}$$

$$ti_{min} = M_{in}\ (ti_{min})$$

Next, the sizing process using the sizer mill will be described.

The temperature of the hollow shell at the inlet side of the sizer mill is set at 550° to 1,150° C. due to the same reasons as those for the above described temperature at the inlet side of the reducer mill.

On the other hand, if the reduction of outside diameter in the sizing process is less than 3%, the object of the sizing can not be achieved and the dimensional accuracy of the product is deteriorated. On the contrary, if the reduction of outside diameter exceeds 15%, surface defects, such as stripe flaws and edge marks due to the jamming of rolls, are produced which deteriorate the surface properties of the product. Accordingly, the reduction of outside diameter in the sizing is set at 3 to 15%.

A solid billet formed of industrial pure titanium (JIS H-4630-3) having the composition shown in Table 11 and having an outside diameter of 173 mm and a length of 2,040 mm was subjected to the piercing by means of an inclined type piercer at the temperature at the inlet side of the piercer of 990° to 1,250° C. to be turned into a first hollow piece having an outside diameter of 178 mm, a wall-thickness of 40 mm and a length of 2,710 mm and the resulting first hollow piece was subjected to the second piercing (elongating) by means of an elongator at the temperature at the inlet side of the elongator of 880° to 1,200° C. to be turned into a second hollow piece having an outside diameter of 190 mm, a wall-thickness of 19.5 mm and a length of 4,500 mm.

Successively, the obtained second hollow piece was subjected to the elongating by means of a plug mill at the temperature at the inlet side of the plug mill of 660° to 1,150° C. to be turned into a hollow shell having an outside diameter of 183 mm, a wall-thickness of 15 mm and a length of 5,940 mm. In this time, the elongation ratio is 1.3.

Subsequently, the obtained hollow shell was reheated to various temperatures and then subjected to the sizing by means of a 2-roll-7-stand sizer mill by varying the reduction of the outside diameter. Properties of a seamless tube formed of pure titanium after the sizing and room-temperature characteristics of the seamless tube formed of pure titanium after annealing for 1 hour at 750° C. are shown in Table 12. In addition, also the standard values for a seamless tube formed of industrial pure titanium (JIS H-4630-3) of the same grade manufactured by hot extrusion and cold drawing in combination are shown in Table 12.

In No. 1, since the temperature at the inlet side of the sizer mill is low, flaws are produced on the surface of the seamless tube, whereby the seamless tube lost the product value prior to the discussion of the mechanical properties. In No. 6, since the temperature at the inlet side of the sizer mill is too high, the surface properties were good but the elongation was remarkably deteriorated. In No. 8, since the temperature at the inlet side of the sizer mill is suitable but the reduction of outside diameter is insufficient, the desired dimensional accuracy could not be secured. In No. 10, since the reduction of outside diameter is too large, the surface defects were produced and thus the seamless tube lost the product value.

Contrary to the above described comparative examples, in Nos. 2 to 5, 7 and 9 according to the present invention, the surface properties are good and the mechanical characteristics meet all the standard values for the seamless tube obtained by hot extrusion and cold drawing in combination.

Next, the same test as the above described one was conducted for a Ti-6Al-4V alloy having a composition shown in Table 13. The results are shown in Table 14.

As is evident from Table 14, the sizing method according to the present invention is effective also for the production of a hollow shell formed of titanium alloys.

In addition, although the hollow shell is produced by the elongating in the respective preferred examples, it is not limitative. For example, a hollow shell produced by piercing by means of the inclined roll, a hollow shell produced by the extrusion, a hollow shell produced by the simply mechanical piercing and the like can be subjected to the reducing or the sizing. Furthermore, a reducer mill or sizer mill having a construction other than the above described ones may be used. In addition, surface-machining or cold drawing can be conducted after the reducing or the sizing.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalents of such meets and bounds thereof are therefore intended to be embraced by the claims.

TABLE 1

| Sample | Al | V | sn | Zr | Mo | Ti | (wt %) β transus |
|---|---|---|---|---|---|---|---|
| (a) | 6.41 | 4.09 | <0.1 | <0.1 | <0.1 | bal. | ≈990° C. |
| (b) | 5.98 | <0.1 | 2.05 | 4.23 | 6.28 | bal. | ≈960° C. |

TABLE 4

| No. | High pressure Water (kg/cm²) | Brush | Piercing Efficiency (%) Substance A | Piercing Efficiency (%) Substance B | Miss-roll Rate (%) Substance A | Miss-roll Rate (%) Substance B | Evaluation |
|---|---|---|---|---|---|---|---|
| 1 | 180 | Yes | 58 | 61 | 0 | 0 | O |
| 2 | 100 | Yes | 55 | 59 | 0 | 0 | O |
| 3 | 50 | Yes | 50 | 52 | 0.5 | 0 | O |
| 4 | 100 | No* | 43 | 45 | 2.0 | 0.8 | Δ |
| 5 | 50 | No* | 40 | 42 | 3.0 | 0.3 | Δ |
| 6 | 45* | Yes | 38 | 40 | 4.0 | 1.5 | X |
| 7 | 45* | No* | 36 | 38 | 5.0 | 3.0 | X |
| 8 | No* | Yes | 35 | 36 | 9.0 | 5.0 | X |
| 9 | No* | No* | 33 | 35 | 12.0 | 8.0 | X |

*Out of conditions of the invention

TABLE 2

| No. | Billet Producing Condition: Material Size (mm) | Heating (°C.) | Finishing Temperature (°C.) | Finishing Size (mm) | Forging Ratio | Piercing Test: Test Material (mm) | Piercer | Heating (°C.) | Piercing Temperature (°C.)*2 | Result of Penetration Test*3: Inner Surface | Outer Surface | Evaluation*4 |
|---|---|---|---|---|---|---|---|---|---|---|---|---|
| 1 | 75 | 1300* | 1180* | ϕ 70 | 1.5* | ϕ 60 | Inclined Roll | 1050 | 1038 | X | O | X |
| 2 | 90 | 1300* | 1169* | 70 | 2.1 | 60 | Inclined Roll | 1050 | 1039 | X | O | X |
| 3 | 115 | 1300* | 1153* | 70 | 3.4 | 60 | Inclined Roll | 1050 | 1037 | X | O | X |
| 4 | 75 | 1250 | 1138* | 70 | 1.5* | 60 | Inclined Roll | 1050 | 1040 | X | O | X |
| 5 | 90 | 1250 | 1124* | 70 | 2.1 | 60 | Inclined Roll | 1050 | 1033 | X | O | X |
| 6 | 115 | 1250 | 1089 | 70 | 3.4 | 60 | Inclined Roll | 1050 | 1041 | O | O | O |
| 7 | 75 | 1200 | 1087 | 70 | 1.5* | 60 | Inclined Roll | 1050 | 1040 | X | O | X |
| 8 | 90 | 1200 | 1065 | 70 | 2.1 | 60 | Inclined Roll | 1050 | 1035 | O | O | O |
| 9 | 115 | 1200 | 1063 | 70 | 3.4 | 60 | Inclined Roll | 1050 | 1031 | O | O | O |
| 10 | 75 | 950 | 873 | 70 | 1.5* | 60 | Inclined Roll | 1050 | 1042 | X | O | X |
| 11 | 90 | 950 | 871 | 70 | 2.1 | 60 | Inclined Roll | 1050 | 1045 | O | O | O |
| 12 | 115 | 950 | 865 | 70 | 3.4 | 60 | Inclined Roll | 1050 | 1039 | O | O | O |
| 13 | 75 | 850 | 791 | 70 | 1.5* | 60 | Inclined Roll | 1050 | 1036 | X | O | X |
| 14 | 90 | 850 | 782 | 70 | 2.1 | 60 | Inclined Roll | 1050 | 1039 | O | O | O |
| 15 | 115 | 850 | 773 | 70 | 3.4 | 60 | Inclined Roll | 1050 | 1033 | O | O | O |
| 16 | 75 | 750* | 673 | 70 | 1.5* | Crack is produced in forging, and no piercing test is done. | | | | — | — | X |
| 17 | 90 | 750* | 669 | 70 | 2.1 | | | | | — | — | X |
| 18 | 115 | 750* | 665 | 70 | 3.4 | | | | | — | — | X |
| 19 | 75 | 650* | 580* | 70 | 1.5* | | | | | — | — | X |
| 20 | 90 | 650* | 569* | 70 | 2.1 | | | | | — | — | X |
| 21 | 115 | 650* | 558* | 70 | 3.4 | | | | | — | — | X |
| 22 | 90 | 1100 | 1038 | 70 | 2.1 | 60 | Inclined Roll | 1300 | 1275* | O | X | X |
| 23 | 90 | 1100 | 1038 | ϕ 70 | 2.1 | ϕ 60 | Inclined Roll | 1250 | 1288 | O | O | O |
| 24 | 90 | 1100 | 1038 | 70 | 2.1 | 60 | Inclined Roll | 1000 | 976 | O | O | O |
| 25 | 90 | 1100 | 1038 | 70 | 2.1 | 60 | Inclined Roll | 950 | 921 | O | O | O |
| 26 | 90 | 1100 | 1038 | 70 | 2.1 | 60 | Inclined Roll | 850 | 838* | X | O | X |
| 27 | 80 | 1250 | 1125* | 65 | 1.5* | 60 | Press Roll | 1050 | 1031 | X | O | X |
| 28 | 95 | 1250 | 1117* | 65 | 2.1 | 60 | Press Roll | 1050 | 1029 | X | O | X |
| 29 | 120 | 1250 | 1080 | 65 | 3.4 | 60 | Press Roll | 1050 | 1033 | O | O | O |
| 30 | 80 | 1200 | 1088 | 65 | 1.5* | 60 | Press Roll | 1050 | 1034 | X | O | X |
| 31 | 95 | 1200 | 1073 | 65 | 2.1 | 60 | Press Roll | 1050 | 1036 | O | O | O |
| 32 | 120 | 1200 | 1065 | 65 | 3.4 | 60 | Press Roll | 1050 | 1030 | O | O | O |
| 33 | 80 | 950 | 868 | 65 | 1.5* | 60 | Press Roll | 1050 | 1029 | X | O | X |
| 34 | 95 | 950 | 860 | 65 | 2.1 | 60 | Press Roll | 1050 | 1033 | O | O | O |
| 35 | 120 | 950 | 842 | 65 | 3.4 | 60 | Press Roll | 1050 | 1031 | O | O | O |
| 36 | 95 | 1100 | 1024 | 65 | 2.1 | 60 | Press Roll | 1300 | 1271* | O | X | X |
| 37 | 95 | 1100 | 1024 | 65 | 2.1 | 60 | Press Roll | 1250 | 1221 | O | O | O |
| 38 | 95 | 1100 | 1024 | 65 | 2.1 | 60 | Press Roll | 1000 | 975 | O | O | O |
| 39 | 95 | 1100 | 1024 | 65 | 2.1 | 60 | Press Roll | 950 | 938 | O | O | O |
| 40 | 95 | 1100 | 1024 | 65 | 2.1 | 60 | Press Roll | 850 | 831* | X | O | X |

Notes;
*Out of conditions of the invention
*2Surface temperature of billet in piercing (Mean value for 3 pieces)
*3X: Flaw O: No flaw
*4O: No flaw on inner and outer surface; X: Flaw on inner or outer surface

TABLE 3

| | Billet Producing Condition | | | | | Piercing Test | | | | Result of Penetration Test*3 | | |
|---|---|---|---|---|---|---|---|---|---|---|---|---|
| No. | Material Size (mm) | Heating (°C.) | Finishing Temperature (°C.) | Finishing Size (mm) | Rolling Ratio | Test Material (mm) | Piercer | Heating (°C.) | Piercing Temperature (°C.)*2 | Inner Surface | Outer Surface | Evaluation*4 |
| 1 | 75 | 1300* | 1191* | ϕ 70 | 1.5* | ϕ 60 | Inclined Roll | 1050 | 1038 | X | O | X |
| 2 | 90 | 1300* | 1189* | 70 | 2.1 | 60 | Inclined Roll | 1050 | 1031 | X | O | X |
| 3 | 115 | 1300* | 1181* | 70 | 3.4 | 60 | Inclined Roll | 1050 | 1029 | X | O | X |
| 4 | 75 | 1250 | 1148* | 70 | 1.5* | 60 | Inclined Roll | 1050 | 1032 | X | O | X |
| 5 | 90 | 1250 | 1137* | 70 | 2.1 | 60 | Inclined Roll | 1050 | 1035 | X | O | X |
| 6 | 115 | 1250 | 1079 | 70 | 3.4 | 60 | Inclined Roll | 1050 | 1033 | O | O | O |
| 7 | 75 | 1200 | 1088 | 70 | 1.5* | 60 | Inclined Roll | 1050 | 1031 | X | O | X |
| 8 | 90 | 1200 | 1073 | 70 | 2.1 | 60 | Inclined Roll | 1050 | 1029 | O | O | O |
| 9 | 115 | 1200 | 1068 | 70 | 3.4 | 60 | Inclined Roll | 1050 | 1025 | O | O | O |
| 10 | 75 | 850 | 782 | 70 | 1.5* | 60 | Inclined Roll | 1050 | 1033 | X | O | X |
| 11 | 90 | 850 | 771 | 70 | 2.1 | 60 | Inclined Roll | 1050 | 1035 | O | O | O |
| 12 | 115 | 850 | 765 | 70 | 3.4 | 60 | Inclined Roll | 1050 | 1032 | O | O | O |
| 13 | 75 | 750 | 671 | 70 | 1.5* | Crack is produced in rolling, and no piercing test is done | | | | — | — | X |
| 14 | 90 | 750 | 663 | 70 | 2.1 | | | | | — | — | X |
| 15 | 115 | 750 | 652 | 70 | 3.4 | | | | | — | — | X |
| 16 | 75 | 650* | 569* | 70 | 1.5* | | | | | — | — | X |
| 17 | 90 | 650* | 553* | 70 | 2.1 | | | | | — | — | X |
| 18 | 115 | 650* | 551* | 70 | 3.4 | | | | | — | — | X |
| 19 | 90 | 1100 | 1005 | 70 | 2.1 | ϕ 60 | Inclined Roll | 1300 | 1271* | O | X | X |
| 20 | 90 | 1100 | 1005 | 70 | 2.1 | 60 | Inclined Roll | 1250 | 1223 | O | O | O |
| 21 | 90 | 1100 | 1005 | 70 | 2.1 | 60 | Inclined Roll | 1000 | 973 | O | O | O |
| 22 | 90 | 1100 | 1005 | 70 | 2.1 | 60 | Inclined Roll | 900 | 877 | O | O | O |
| 23 | 90 | 1100 | 1005 | 70 | 2.1 | 60 | Inclined Roll | 850 | 830* | X | O | X |

Notes;
*Out of conditions of the invention
*2Surface temperature of billet in piercing (Mean value for 3 pieces)
*3X: Flaw O: No flaw
*4O: No flaw on inner and outer surface; X: Flaw on inner or outer surface

TABLE 5

| $\bar{O}$ | Fe | C | N | (wt %) H |
|---|---|---|---|---|
| 0.27 | 0.22 | 0.07 | 0.006 | 0.002 |

TABLE 8

| $\bar{O}$ | Fe | C | N | H | Al | (wt %) V |
|---|---|---|---|---|---|---|
| 0.27 | 0.22 | 0.07 | 0.006 | 0.002 | 6.03 | 4.10 |

TABLE 6

| No. | Reducing Condition: Temperature at Inlet side of Rolling Mill (°C.) | Reducing Condition: Reduction of Outside Diameter (%) | Reducing Condition: Size (outside diameter mm × wall-thickness mm) | Property of Product | Room-temperature Tensile Properties: YS (kg/mm²) | Room-temperature Tensile Properties: TS (kg/mm²) | Room-temperature Tensile Properties: El (%) | Evaluation |
|---|---|---|---|---|---|---|---|---|
| 1 | 850 | 9.2 | 127 × 6.25 | Good | 38.3 | 52.0 | 27.9 | O |
| 2 | 850 | 36.5 | 88.9 × 6.0 | Good | 38.2 | 52.1 | 28.5 | O |
| 3 | 850 | 54.6 | 63.5 × 5.75 | Good | 39.5 | 54.2 | 30.6 | O |
| 4 | 850 | 69.5 | 42.7 × 5.5 | Good | 40.9 | 57.1 | 30.8 | O |
| 5 | 850 | 78.5 | 30.0 × 5.25 | Good | 41.0 | 58.2 | 31.0 | O |
| 6 | 850 | 80.5* | 27.2 × 5.25 | Jamming of Rolls Edge Mark | 43.0 | 59.0 | 31.8 | X |
| | | JIS-H4630-3 | | | — | 49/63 | 18 or more | — |

*Out of conditions of the invention

TABLE 7

| No. | Reducing Condition: Temperature at Inlet side of Rilling Mill (°C.) | Reducing Condition: Reduction of Outside Diameter (%) | Reducing Condition: Size (outside diameter mm × wall-thickness mm) | Property of Product | Room-temperature Tensile Properties: YS (kg/mm²) | Room-temperature Tensile Properties: TS (kg/mm²) | Room-temperature Tensile Properties: El (%) | Evaluation |
|---|---|---|---|---|---|---|---|---|
| 1 | 500* | 54.6 | 63.5 × 5.75 | Crack in Inner Surface | 45.5 | 58.2 | — | X |
| 2 | 600 | 54.6 | 63.5 × 5.75 | Good | 41.9 | 56.8 | 26.4 | O |
| 3 | 850 | 54.6 | 63.5 × 5.75 | Good | 39.5 | 54.2 | 28.5 | O |
| 4 | 1100 | 54.6 | 63.5 × 5.75 | Good | 37.1 | 51.2 | 28.5 | O |
| 5 | 1150* | 54.6 | 63.5 × 5.75 | Jamming of Rolls | 25.9 | 47.1 | 11.1 | X |
| | | JIS-H4630-3 | | | — | 49/63 | 18 or more | — |

*Out of conditions of the invention

TABLE 9

| No. | Reducing Condition: Temperature at Inlet side of Rolling Mill (°C.) | Reducing Condition: Reduction of Outside Diameter (%) | Reducing Condition: Size (outside diameter mm × wall-thickness mm) | Property of Product | Room-temperature Tensile Properties: YS (kg/mm²) | Room-temperature Tensile Properties: TS (kg/mm²) | Room-temperature Tensile Properties: El (%) | Evaluation |
|---|---|---|---|---|---|---|---|---|
| 1 | 850 | 9.2 | 127 × 6.25 | Good | 92.8 | 100.1 | 17.2 | O |
| 2 | 850 | 36.5 | 88.9 × 6.0 | Good | 93.7 | 100.9 | 18.0 | O |
| 3 | 850 | 54.6 | 63.5 × 5.75 | Good | 94.1 | 101.9 | 17.4 | O |
| 4 | 850 | 69.5 | 42.7 × 5.5 | Good | 95.1 | 102.3 | 17.3 | O |
| 5 | 850 | 78.5 | 30.0 × 5.25 | Good | 96.9 | 103.1 | 16.8 | O |
| 6 | 850 | 80.5* | 27.2 × 5.25 | Jamming of Rolls Edge Mark | 97.1 | 103.3 | 17.2 | X |

*Out of conditions of the invention

TABLE 10

| No. | Reducing Condition: Temperature at Inlet side of Rolling Mill (°C.) | Reducing Condition: Reduction of Outside Diameter (%) | Reducing Condition: Size (outside diameter mm × wall-thickness mm) | Property of Product | Room-temperature Tensile Properties: YS (kg/mm²) | Room-temperature Tensile Properties: TS (kg/mm²) | Room-temperature Tensile Properties: El (%) | Evaluation |
|---|---|---|---|---|---|---|---|---|
| 1 | 500* | 54.6 | 63.5 × 5.75 | Cracks, Voids | — | — | — | X |
| 2 | 600 | 54.6 | 63.5 × 5.75 | Good | 99.8 | 105.9 | 17.4 | O |
| 3 | 850 | 54.6 | 63.5 × 5.75 | Good | 94.1 | 101.9 | 17.4 | O |
| 4 | 1100 | 54.6 | 63.5 × 5.75 | Good | 92.3 | 102.3 | 11.9 | O |
| 5 | 1150* | 54.6 | 63.5 × 5.75 | Rough Skin on Surface | 90.2 | 100.9 | 3.8 | X |

*Out of conditions of the invention

TABLE 11

| $\bar{O}$ | Fe | C | N | (wt %) H |
|---|---|---|---|---|
| 0.27 | 0.22 | 0.07 | 0.006 | 0.002 |

said $\alpha$-type titanium alloy is one selected from the group consisting of Ti-0.15Pd, Ti-0.8Ni-0.3Mo and Ti-5Al-2.6Sn.

4. A method of manufacturing a seamless tube formed of a titanium material as set forth in claim 1, wherein said titanium alloy is an $\alpha+\beta$-type titanium alloy.

TABLE 12

| No. | Hollow Shell Sizing Condition: Temperature at Inlet side of Sizer (°C.) | Hollow Shell Sizing Condition: Reduction of Outside Diameter (%) | Property of Product | Room-temperature Tensile Properties: YS (kg/mm²) | TS (kg/mm²) | El (%) | Evaluation |
|---|---|---|---|---|---|---|---|
| 1 | 500* | 8.0 | Flaws | — | — | — | X |
| 2 | 550 | 8.0 | Good | 44.1 | 59.0 | 29.0 | O |
| 3 | 700 | 8.0 | Good | 43.5 | 57.9 | 30.5 | O |
| 4 | 900 | 8.0 | Good | 43.0 | 58.1 | 30.2 | O |
| 5 | 1150 | 8.0 | Good | 42.8 | 57.0 | 28.2 | O |
| 6 | 1200* | 8.0 | Good | 40.0 | 55.2 | 9.5 | X |
| 7 | 700 | 3.0 | Good | 41.1 | 53.5 | 32.2 | O |
| 8 | 700 | 2.5* | Insufficiency of Outside Diameter | — | — | — | X |
| 9 | 900 | 15.0 | Good | 43.8 | 58.0 | 30.0 | O |
| 10 | 900 | 16.0* | Flaws | — | — | — | X |
| | | JIS-H4630-3 | | — | 49/63 | 18 or more | — |

*Out of conditions of the invention

TABLE 13

| $\bar{O}$ | Fe | C | N | H | Al | (wt %) V |
|---|---|---|---|---|---|---|
| 0.27 | 0.22 | 0.07 | 0.006 | 0.002 | 6.03 | 4.10 |

5. A method of manufacturing a seamless tube formed of a titanium material as set forth in claim 4, wherein said $\alpha+\beta$-type titanium alloy is one selected from the group consisting of Ti-8Al-1Mo-1V, Ti-3Al-2.5V, Ti-6Al-4V, Ti-6Al-6V-2Sn, Ti-6Al-2Sn-4Zr-6Mo and Ti-6Al-2Sn-4Zr-2Mo.

TABLE 14

| No. | Hollow Shell Sizing Condition: Temperature at Inlet side of Sizer (°C.) | Hollow Shell Sizing Condition: Reduction of Outside Diameter (%) | Property of Product | Room-temperature Tensile Properties: YS (kg/mm²) | TS (kg/mm²) | El (%) | Evaluation |
|---|---|---|---|---|---|---|---|
| 11 | 500* | 6.0 | Flaws | — | — | — | X |
| 12 | 550 | 6.0 | Good | 95.8 | 105.0 | 20.3 | O |
| 13 | 600 | 6.0 | Good | 95.2 | 104.8 | 20.5 | O |
| 14 | 900 | 6.0 | Good | 95.0 | 104.2 | 21.0 | O |
| 15 | 1150 | 6.0 | Good | 93.1 | 102.3 | 21.2 | O |
| 16 | 1200* | 6.0 | Good | 92.0 | 101.0 | 3.8 | X |
| 17 | 700 | 3.0 | Good | 94.9 | 104.1 | 20.6 | O |
| 18 | 700 | 2.5* | Insufficiency of Outside Diameter | — | — | — | X |
| 19 | 900 | 15.0 | Good | 95.3 | 105.0 | 20.0 | O |
| 20 | 900 | 16.0* | Flaws | — | — | — | X |

*Out of conditions of the invention

What is claimed is:

1. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet so as to be turned into a hollow piece; a step of elongating the resulting hollow piece so as to be turned into a hollow shell; and a step of sizing or a step of reducing the resulting hollow shell;

said ingot being heated within a temperature range of 850° to 1,250° C., a final temperature being within a range of 600° to 1,100° C., and a working degree being 50% or more during the first step, and said solid billet being subjected to piercing within a temperature range of $\beta$ transus−100° to 1,250° C. during the piercing step.

2. A method of manufacturing a seamless tube formed of a titanium material as set forth in claim 1, wherein said titanium alloy is an $\alpha$-type titanium alloy.

3. A method of manufacturing a seamless tube formed of a titanium material as set forth in claim 2, wherein

6. A method of manufacturing a seamless tube formed of a titanium material as set forth in claim 1, wherein said titanium alloy is a $\beta$-type titanium alloy.

7. A method of manufacturing a seamless tube formed of a titanium material as set forth in claim 1, further comprising, between said piercing step and said elongating step, a further elongating step or a hollow piece sizing step for regulating a size of said hollow piece.

8. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet by means of a piercer having inclined rolls so as to be turned into a hollow piece; a step of elongating the resulting hollow piece so as to be turned into a hollow shell; and a step of sizing or a step of reducing the resulting hollow shell;

said inclined rolls being provided with a nozzle means for blasting a high-pressure water at a pressure of 50 kg/cm² or more and a brush means for cleaning said inclined rolls, said piercing step being performed while blasting said inclined rolls with water from said nozzle means and while cleaning said inclined rolls with said brush means.

9. A method of manufacturing a seamless tube formed of a titanium material as set forth in claim 8, wherein said ingot is heated within a temperature range of 850° to 1,250° C., a final temperature is within a range of 600° to 1,100° C., and a working degree is 50% or more during the first step to obtain said solid billet, and during the piercing step the resulting solid billet is subjected to piercing within a temperature range of $\beta$ transus−100° to 1,250° C. so as to be turned into said hollow piece.

10. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet so as to be turned into a hollow piece; a step of elongating the resulting hollow piece so as to be turned into a hollow shell; and a step of reducing the resulting hollow shell;

said hollow shell being subjected to reducing by means of a reducer mill during the reducing step, a temperature of said hollow shell at an inlet side of said reducer mill being in the range of 600° to 1,100° C., and a reduction of an outside diameter of the hollow shell being 80% or less during the reducing step.

11. A method of manufacturing a seamless tube formed of a titanium material as set forth in claim 10, further comprising, between said piercing step and said elongating step, a further elongating step or a hollow piece sizing step for regulating a size of said hollow piece.

12. A method of manufacturing a seamless tube formed of a titanium material as set forth in claim 10, wherein a rectangular ratio ($\lambda$) of roll grooves in said reducer mill is set during the reducing step according to a wall-thickness (t) and an outside diameter (D) of the seamless tube to be manufactured, such that when t/D is less than 10%, $\lambda \leqq 0.7$;

when $10\% \leqq t/D < 15\%$, $\lambda \leqq 0.8$; and when t/D is 15% or more, $\lambda \leqq 0.9$.

13. A method of manufacturing a seamless tube formed of a titanium material as set forth in claim 10, wherein said hollow piece is subjected to elongating by means of a mandrel mill during said elongating step.

14. A method of manufacturing a seamless tube formed of a titanium material as set forth in claim 10, wherein said ingot is heated within a temperature range of 850° to 1,250° C., a final temperature is within a range of 600° to 1,100° C., and a working degree is 50% or more during the first step to obtain said solid billet, and during the piercing step the resulting solid billet is subjected to piercing within a temperature range of $\beta$ transus−100° to 1,250° C. so as to be turned into said hollow piece.

15. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet so as to be turned into a hollow piece; a step of elongating the resulting hollow piece so as to be turned into a hollow shell; and a step of sizing the resulting hollow shell;

said hollow shell being subjected to sizing by means of a sizer mill during the sizing step, a temperature of said hollow shell at an inlet side of said sizer mill being in the range of 550° to 1,150° C., and a reduction of an outside diameter of the hollow shell being 3 to 15% during the sizing step.

16. A method of manufacturing a seamless tube formed of a titanium material as set forth in claim 15, further comprising, between said piercing step and said elongating step, a further elongating step or a hollow piece sizing step for regulating a size of said hollow piece.

17. A method of manufacturing a seamless tube formed of a titanium material as set forth in claim 15, wherein during said elongating step said hollow piece is subjected to elongating by means of a plug mill.

18. A method of manufacturing a seamless tube formed of a titanium material as set forth in claim 15, wherein said ingot is heated within a temperature range of 850° to 1,250° C., a final temperature is within a range of 600° to 1,100° C., and a working degree is 50% or more during the first step to obtain said solid billet, and during the piercing step the resulting solid billet is subjected to piercing within a temperature range of $\beta$ transus−100° to 1,250° C. so as to be turned into said hollow piece.

19. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet so as to be turned into a first hollow piece; a step of elongating the resulting first hollow piece so as to be turned into a second hollow piece; a step of further elongating the resulting second hollow piece so as to be turned into a hollow shell; and a step of sizing the resulting hollow shell;

said ingot being heated within a temperature range of 850° to 1,250° C., a final temperature being within a range of 600° to 1,100° C., and a working degree being 50% or more during the first step, and said solid billet being subjected to piercing within a temperature range of $\beta$ transus−100° to 1,250° C. during the piercing step.

20. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet by means of a piercer having inclined rolls so as to be turned into a first hollow piece; a step of elongating the resulting first hollow piece by means of an elongator having inclined rolls so as to be turned into a second hollow piece; a step of further elongating the resulting second hollow piece so as to be turned into a hollow shell; and a step of sizing or a step of reducing the resulting hollow shell;

said inclined rolls of said piercer being provided with a nozzle means for blasting a high-pressure water at a pressure of 50 kg/cm$^2$ or more and a brush means for cleaning the inclined rolls, said piercing step being performed while blasting said inclined rolls with water from said nozzle means and while cleaning said inclined rolls with said brush means.

21. A method of manufacturing a seamless tube formed of a titanium material as set forth in claim 20, wherein said ingot is heated within a temperature range of 850° to 1,250° C., a final temperature is within a range of 600° to 1,100° C., and a working degree is 50% or more during said first step to obtain said solid billet, and the resulting solid billet is subjected to piercing within a temperature range of $\beta$ transus − 100° to 1,250° C. so as to be turned into said hollow piece during said piercing step.

22. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet by means of a piercer having inclined rolls so as to be turned into a first hollow piece; a step of elongating the resulting first hollow piece by means of an elongator having inclined rolls so as to be turned into a second hollow piece; a step of further elongating the resulting second hollow piece so as to be turned into hollow shell; and a step of sizing or a step of reducing the resulting hollow shell;

said inclined rolls of said elongator being provided with nozzle means for blasting water at a high-pressure of 50 kg/cm$^2$ or more and brush means for cleaning the inclined rolls, said elongating step being performed while blasting said inclined rolls with water from said nozzle means and while cleaning said inclined rolls with said brush means.

23. A method of manufacturing a seamless tube formed of a titanium material by the use of the Mannesmann's method comprising a first step of heating and working an ingot formed of pure titanium or titanium alloy so as to be turned into a solid billet; a step of piercing the resulting solid billet by means of a piercer having inclined rolls so as to be turned into a first hollow piece; a step of elongating the resulting first hollow piece by means of an elongator having inclined rolls so as to be turned into a second hollow piece; a step of further elongating the resulting second hollow piece so as to be turned into a hollow shell; and a step of sizing or a step of reducing the resulting hollow shell;

said inclined rolls of said piercer and said elongator being provided with nozzle means for blasting water at a high-pressure of 50 kg/cm$^2$ or more and brush means for cleaning the inclined rolls, said piercing and elongating steps being performed while blasting said inclined rolls with water from said nozzle means and while cleaning said inclined rolls with said brush means.

24. A method of manufacturing a seamless tube formed of a titanium material as set forth in claim 22, wherein said ingot is heated within a temperature range of 850° to 1,250° C., a final temperature is within a range of 600° to 1,100° C., and a working degree is 50% or more during said first step to obtain said solid billet, and the resulting solid billet is subjected to piercing within a temperature range of $\beta$ transus − 100° to 1,250° C. so as to be turned into said hollow piece during said piercing step.

25. A method of manufacturing a seamless tube formed of a titanium material as set forth in claim 23, wherein said ingot is heated within a temperature range of 850° to 1,250° C., a final temperature is within a range of 600° to 1,100° C., and a working degree is 50% or more during said first step to obtain said solid billet, and the resulting solid billet is subjected to piercing within a temperature range of $\beta$ transus − 100° to 1,250° C. so as to be turned into said hollow piece during said piercing step.

* * * * *